US007530927B2

(12) United States Patent
Chuang

(10) Patent No.: US 7,530,927 B2
(45) Date of Patent: May 12, 2009

(54) STEPPING EXERCISER

(76) Inventor: Jin Chen Chuang, No. 17, Lane 301, Nanyang Road, Fong Yuan, Taichung Hsien 42083 (TW)

( * ) Notice: Subject to any disclaimer, the term of this patent is extended or adjusted under 35 U.S.C. 154(b) by 681 days.

(21) Appl. No.: 11/176,524

(22) Filed: Jul. 6, 2005

(65) Prior Publication Data

US 2008/0194387 A1 Aug. 14, 2008

(51) Int. Cl.
*A63B 22/06* (2006.01)

(52) U.S. Cl. ..... 482/53

(58) Field of Classification Search ..... 482/51–53, 482/114–119
See application file for complete search history.

(56) References Cited

U.S. PATENT DOCUMENTS 5,628,709 A * 5/1997 Chen ..... 482/53
5,632,708 A * 5/1997 Wilkinson et al. ..... 482/52
5,665,033 A 9/1997 Palmer ..... 482/71
6,277,055 B1 * 8/2001 Birrell et al. ..... 482/52
6,709,366 B2 * 3/2004 Chuang ..... 482/53
6,830,539 B2 * 12/2004 Chuang ..... 482/53
6,918,857 B2 * 7/2005 Chen ..... 482/53
7,300,387 B2 * 11/2007 Wang ..... 482/52
7,384,378 B2 * 6/2008 Chen ..... 482/53
2003/0216224 A1 * 11/2003 Chuang ..... 482/53
2005/0113215 A1 * 5/2005 Chuang ..... 482/52

* cited by examiner

*Primary Examiner*—Steve R Crow
(74) *Attorney, Agent, or Firm*—Charles E. Baxley

(57) ABSTRACT

A stepping exerciser includes a base having a pair of inclined pivot axles, a pair of foot pedals having one end rotatably attaching to the inclined pivot axles, to allow the foot pedals to be stepped downwardly and outwardly by a user, and a lever rotatably attached to the base and having two ends engaged beneath the foot pedals, to couple the foot pedals together, and to allow one of the foot pedals to be moved upwardly when the other foot pedal is stepped downwardly by the user. The lever includes two pads for engaging with the foot pedals. A resistive device may provide a resistive force against the foot pedals.

3 Claims, 5 Drawing Sheets

STEPPING EXERCISER

BACKGROUND OF THE INVENTION

1. Field of the Invention

The present invention relates to a stepping exerciser, and more particularly to a stepping exerciser including inclined pivot axles to tiltedly support foot pedals, and including a simplified coupling device for coupling and supporting the foot pedals together.

2. Description of the Prior Art

Typical stepping exercisers comprise a pair of foot pedals to be stepped downwardly and alternatively by users, in order to train the lower muscle groups of the users. Normally, the front portions of the foot pedals are rotatably or pivotally attached to a straight and lateral axle, for allowing the foot pedals to be moved upwardly and downwardly.

In most of the typical stepping exercisers, such as U.S. Pat. No. 5,628,709 to Chen, a pair of foot pedals are also disclosed and are also arranged to be stepped downwardly and alternatively by users. However, in the typical stepping exercisers, when the foot pedals are stepped downwardly, the foot pedals may be moved downwardly and inwardly which is contrary to the working status of people, such that the typical stepping exercisers may not be smoothly operated by the users.

U.S. Pat. No. 5,665,033 to Palmer discloses the other typical stepping exerciser comprising a pair of foot pedals pivotally or rotatably attached to a pair of inclined pivot axles, and arranged to be stepped downwardly and alternatively by users. However, in the typical stepping exercisers, a complicated coupling device is required to be provided and coupled between the foot pedals, for allowing the foot pedals to be stepped downwardly and alternatively by the users.

In addition, the inclined pivot axles for pivotally or rotatably supporting the foot pedals are extended simultaneously from a vertical plane that is extended upwardly from the base, such that the vertical plane has to support both the inclined pivot axles and both the foot pedals, and thus has to be made very strong, in order to solidly support both the foot pedals.

The present invention has arisen to mitigate and/or obviate the afore-described disadvantages of the conventional stepping exercisers.

SUMMARY OF THE INVENTION

The primary objective of the present invention is to provide a stepping exerciser including inclined pivot axles to tiltedly support foot pedals, and including a simplified coupling device for coupling and supporting the foot pedals together, and for allowing the foot pedals to be easily operated by the users.

In accordance with one aspect of the invention, there is provided a stepping exerciser comprising a base including a pair of inclined pivot axles extended outwardly and upwardly therefrom, a pair of foot pedals including a first end rotatably attaching to the inclined pivot axles of the base respectively, and arranged to allow the foot pedals to be stepped downwardly and outwardly by a user, and a lever rotatably attached to the base, and including two ends engaged beneath the foot pedals respectively, to couple the foot pedals together, and to allow one of the foot pedals to be moved upwardly when the other foot pedal is stepped downwardly by the user.

The lever includes two pads attached to the ends respectively, for engaging with and for supporting the foot pedals. The pads of the lever each includes at least one flat surface for engaging with the foot pedals. The base includes a support extended upwardly therefrom, and the lever is rotatably attached to the support with a pivot shaft.

A resistive device may further be provided and disposed between the foot pedals and the base, to provide a resistive force against the foot pedals and against the stepping exercises of the users. The resistive device includes a gasket having a hole to receive a stud. The gasket is made of PU materials. The stud is made of $MoS_2$. One or more cables may further be provided and coupled to the base, for being held by the users, and for allowing the users to train or to exercise the upper muscle groups simultaneously while conducting the stepping exercises.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
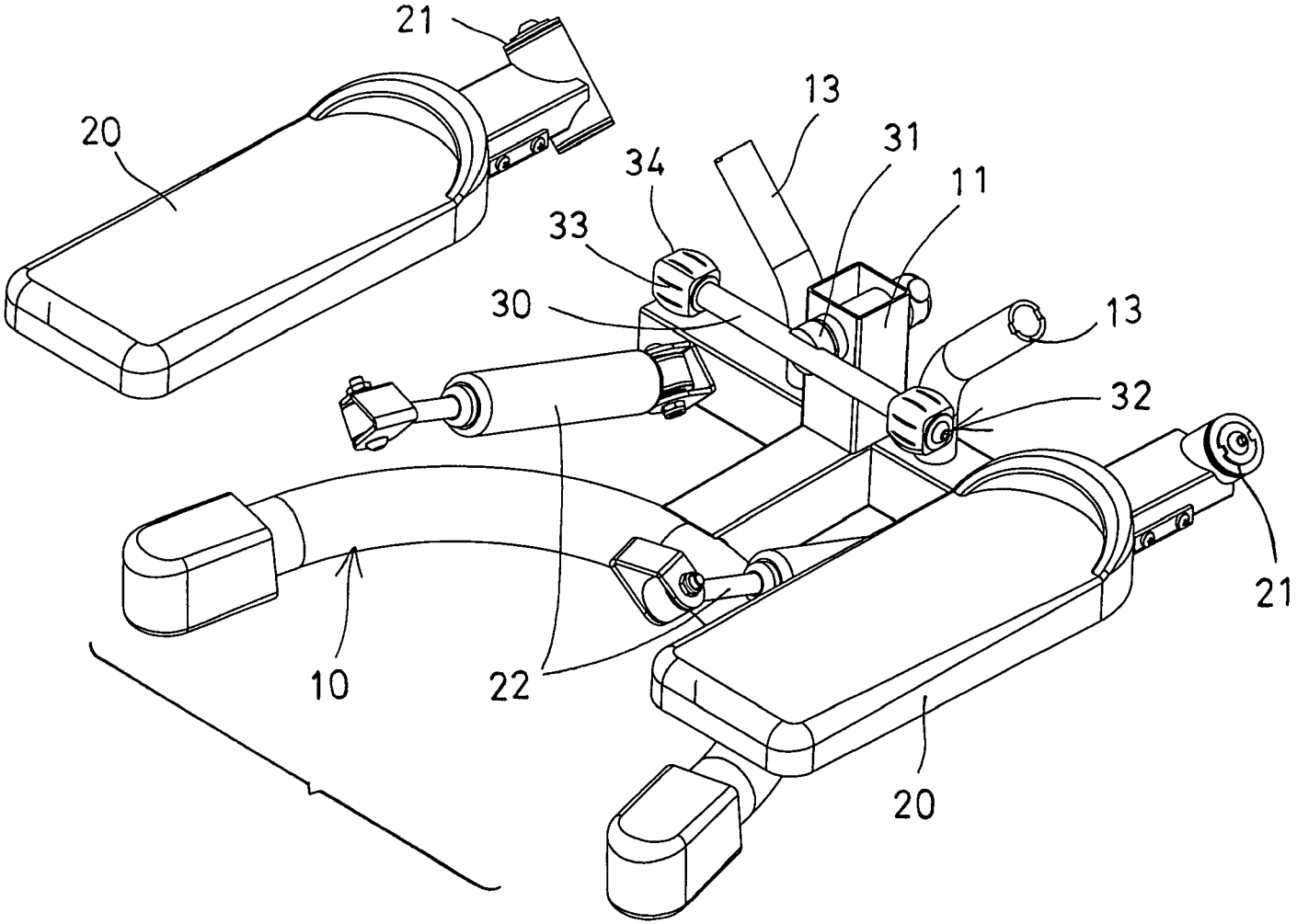
FIG. 1 is a partial exploded view of a stepping exerciser in accordance with the present invention.
Figure 2:
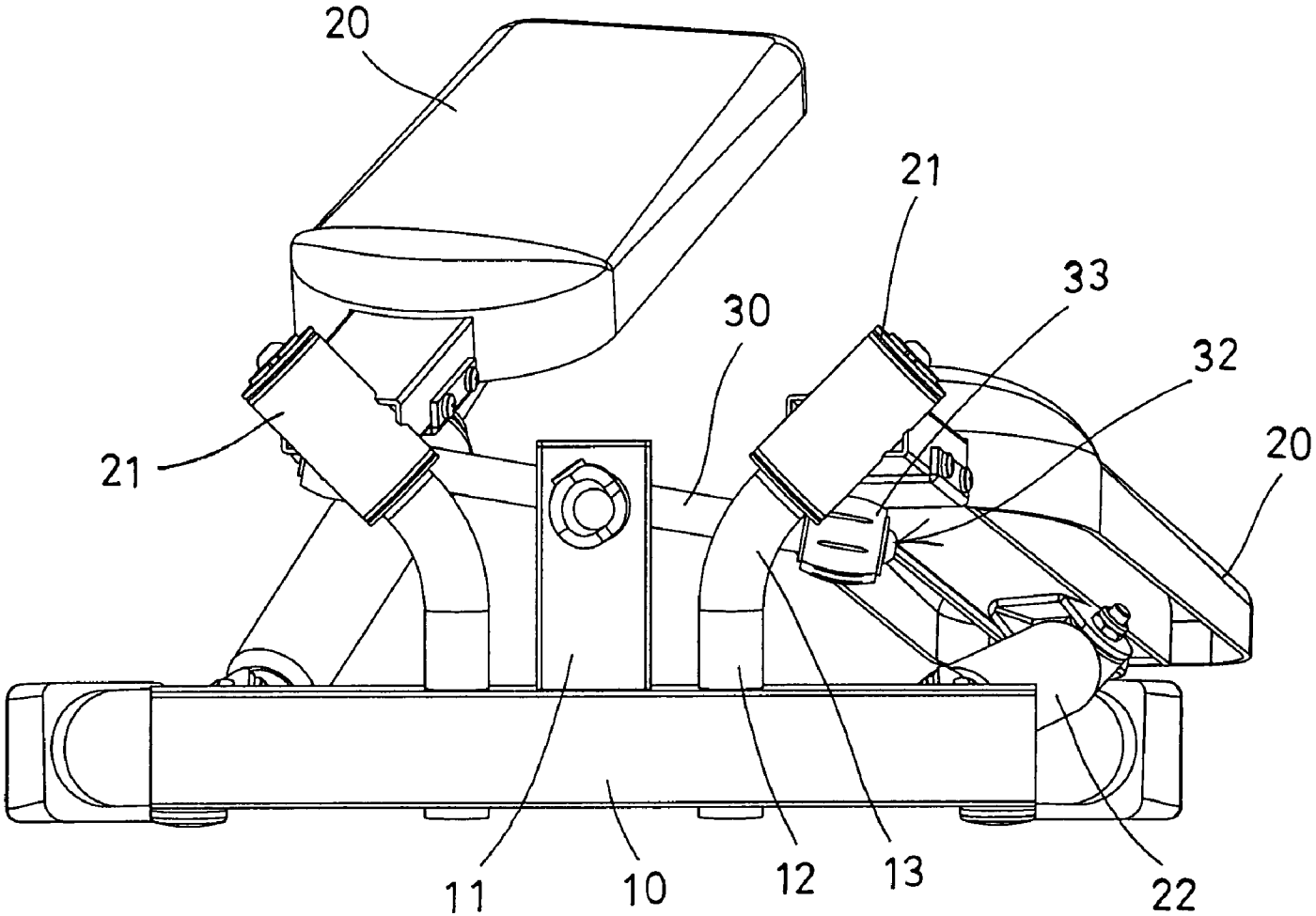
FIG. 2 is a front plan view of the stepping exerciser.
Figure 3:
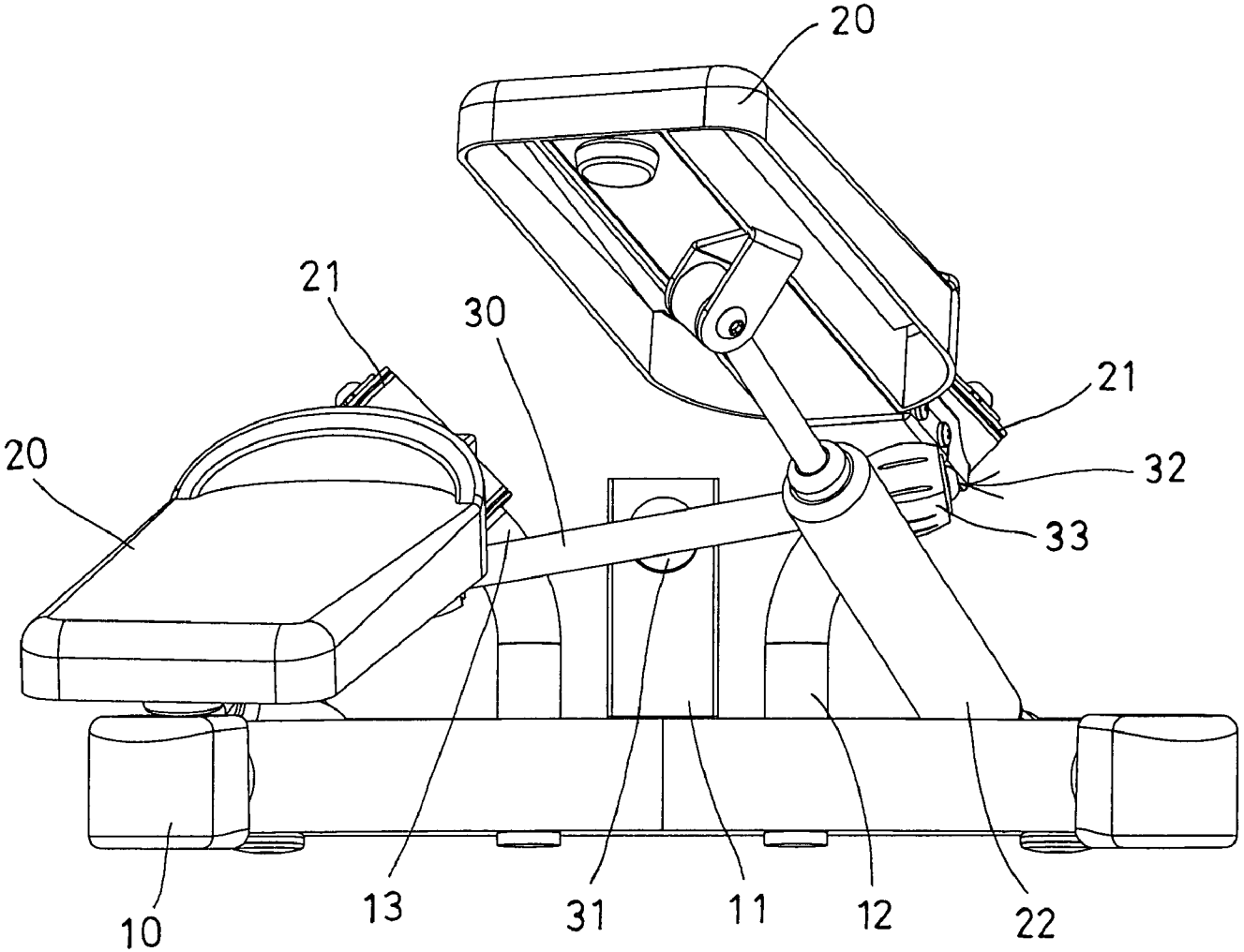
FIG. 3 is a rear plan view of the stepping exerciser.
Figure 4:
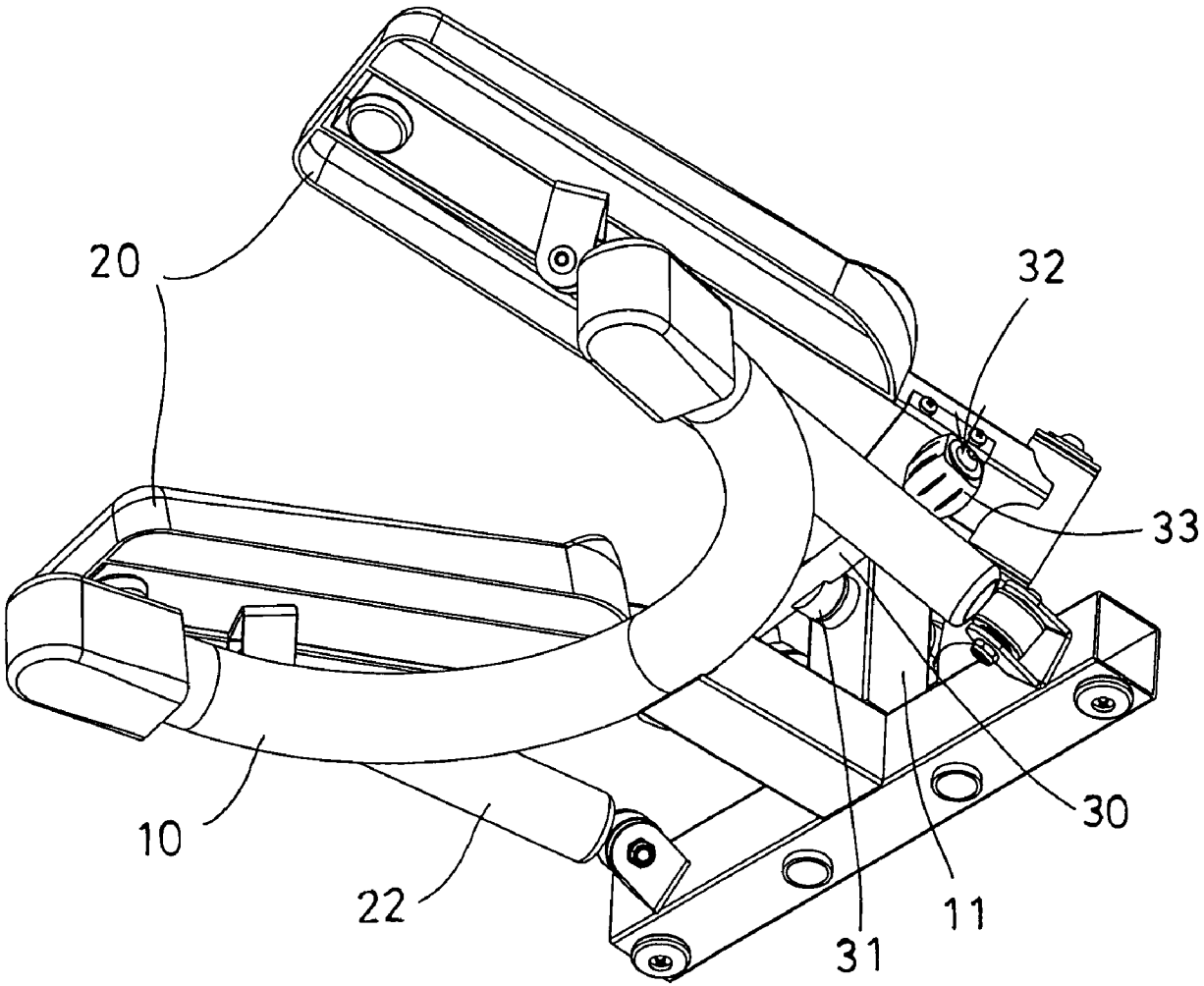
FIG. 4 is a bottom perspective view of the stepping exerciser.

Referring to the drawings, and initially to FIGS. 1-4, a stepping exerciser in accordance with the present invention comprises a base 10 including a support 11 extended upwardly therefrom for supporting a counter or control device (not shown) theon, and including two posts 12 extended upwardly from the base 10, and preferably disposed and located on two different sides of the support 11, or arranged to have the support 11 to be disposed and located between the posts 12. A pair of pivot axle 13 are extended outwardly and upwardly from the posts 12 respectively, or directly extended outwardly and upwardly from the base 10.

A pair of foot pedals 20 each includes one end 21 having a sleeve 21 formed or provided thereon, for rotatably attaching or securing to the inclined pivot axles 13 of the base 10, which are arranged to allow the foot pedals 20 to be stepped downwardly and alternatively by the users, and to allow the foot pedals 20 to be moved downwardly and outwardly when the foot pedals 20 are stepped downwardly by the users.

A resistive device 22, such as hydraulic or pneumatic cylinders, spring members, resilient belts, or other resistive mechanisms, may be disposed between the foot pedals 20 and the base 10, to provide a resistive force against the foot pedals 20, and thus to provide the resistive force against the stepping operations of the users, and may include an adjustable structure (not shown) for adjusting the resistive forces of the resistive device 22, in order to fit various operators or users.

A lever 30 is pivotally or rotatably attached to the support 11 or the base 10 with a pivot shaft 31, and includes two ends 32 engaged beneath the foot pedals 20 respectively, to couple the foot pedals 20 together, and to allow one of the foot pedals 20 to be moved upwardly when the other foot pedal 20 is stepped downwardly by the users.

It is preferable that the lever 30 includes two pads 33 attached to the ends 32 respectively, and made of soft or resilient materials, such as rubber, plastic or other synthetic materials, for resiliently supporting the foot pedals 20, and for preventing the foot pedals 20 from being scrubbed or damaged by the lever 30. It is further preferable that the pads 33 each includes one or more flat surfaces 34 formed thereon, for flatly engaging with the foot pedals 20.

The lever 30 includes a greatly simplified structure to support and to couple the foot pedals 20 together, in which the foot pedals 20 are pivotally or rotatably attached or secured to the inclined pivot axles 13 of the base 10, and the inclined pivot axles 13 are separated from each other, such that the stepping movement or operations of one of the foot pedals 20 will not be affected by the other. Furthermore, the lever 30 which is attached to the base 10 or the support 11 may further stably support and couple the foot pedals 20 together.

Figure 5:
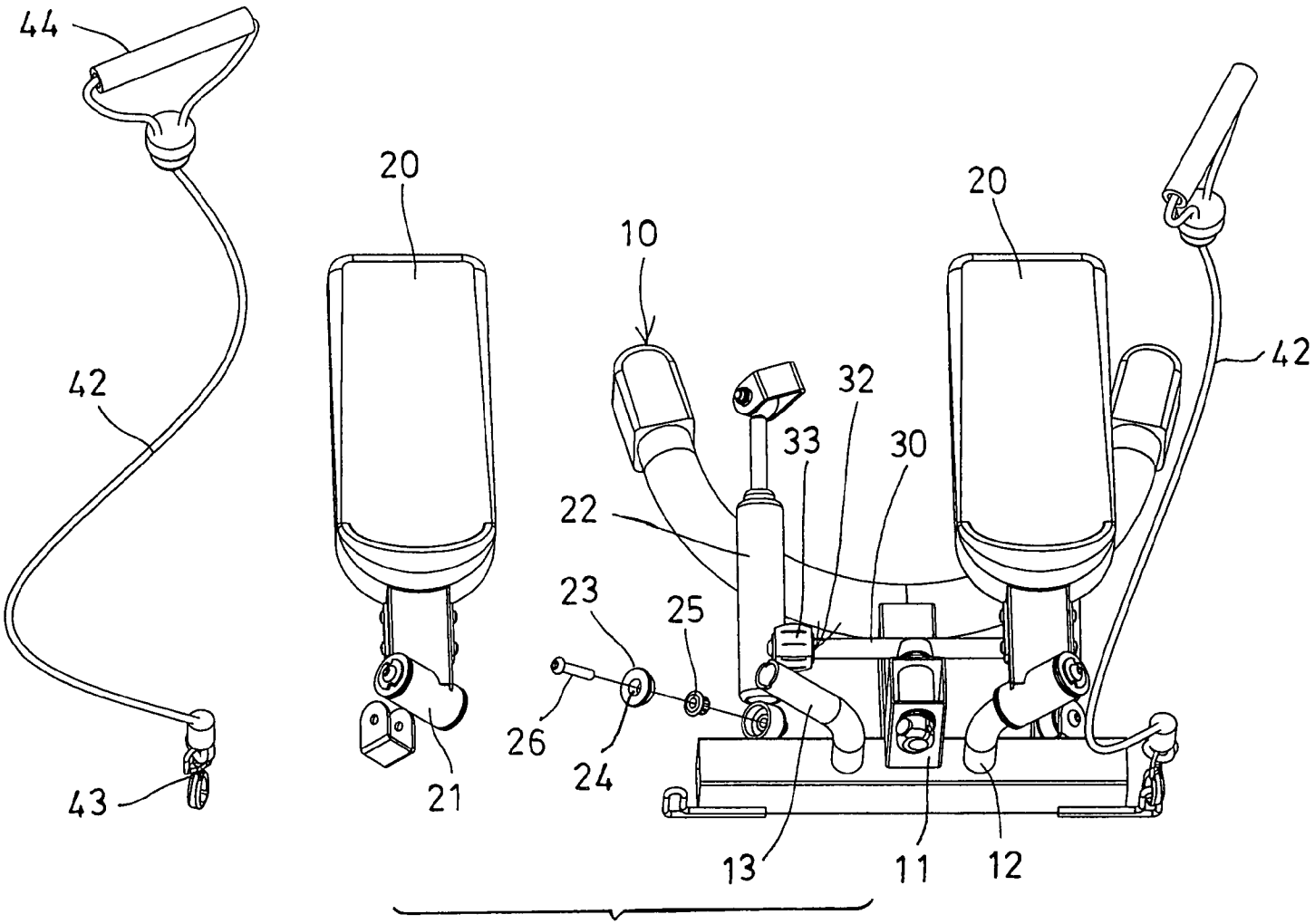
FIG. 5 is another partial exploded view of the stepping exerciser.

As shown in FIG. 5, the resistive device 22 may include a gasket 23 preferably made of rubber or resilient or cushioning materials, such as polyurethane (PU) materials, and having a hole 24 formed therein to receive a stud 25 therein which may be made of plastic or synthetic materials, such as $MoS_2$, or the like, and may include a pivot pin 26 engaged through the stud 25 and the gasket 23, for pivotally attaching the resistive device 22 to the base 10, and to allow the resistive device 22 to be slightly rotated relative to the base 10.

One or more, such as two plugs 40 and couplers or hooks 41 may further be attached to the base 10, and one or more, such as two resilient cables 42 may further be provided and may have couplers 43 provided on one end thereof for coupling to the hooks 41 of the base 10, and may have hand grips 44 provided on the other end for being held by the users, and for allowing the users to train or to exercise the upper muscle groups simultaneously while conducting the stepping exercises.

Accordingly, the stepping exerciser in accordance with the present invention includes two inclined pivot axles to tiltedly or inclinedly support the foot pedals respectively, and includes a simplified coupling device for coupling and supporting the foot pedals together, and for allowing the foot pedals to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stepping exerciser comprising:

a base including a support extended upwardly therefrom and including a pair of posts extended upwardly therefrom, and each having an inclined pivot axle extended outwardly and upwardly therefrom, a pair of foot pedals each including a first end rotatably attaching to said inclined pivot axles of said base respectively, and arranged to allow said foot pedals to be stepped downwardly and outwardly by a user, a lever rotatably attached to said support of said base with a horizontal pivot shaft, and including two ends engaged beneath said foot pedals for vertical movement of said ends respectively, to couple said foot pedals together, and to allow one foot pedal to be moved upwardly when the other foot pedal is stepped downwardly by said user, and said lever including two pads attached to said ends respectively for engaging with and for supporting said foot pedals, and two resistive devices coupled between said foot pedals and said base respectively to provide a resistive force against said foot pedals, said resistive devices each including a hydraulic cylinder and a gasket made of resilient materials and having a hole formed therein to receive a stud therein, and a pivot pin engaged through said stud and said gasket for pivotally attaching said gasket to one end of said hydraulic cylinder and said base.

2. The stepping exerciser as claimed in claim 1, wherein said pads of said lever each includes at least one flat surface for engaging with said foot pedals.

3. The stepping exerciser as claimed in claim 1 further comprising at least one exercise cable coupled to said base. comprising at least one execise cable coupled to said base.

* * * * *